US010544603B1

(12) United States Patent
Harripersaud

(10) Patent No.: US 10,544,603 B1
(45) Date of Patent: Jan. 28, 2020

(54) FLUORESCENT DOORKNOB ASSEMBLY

(71) Applicant: Richie Harripersaud, Orlando, FL (US)

(72) Inventor: Richie Harripersaud, Orlando, FL (US)

( * ) Notice: Subject to any disclaimer, the term of this patent is extended or adjusted under 35 U.S.C. 154(b) by 0 days.

(21) Appl. No.: 16/169,054

(22) Filed: Oct. 24, 2018

(51) Int. Cl.
*E05B 17/10* (2006.01)
*E05B 1/00* (2006.01)

(52) U.S. Cl.
CPC ..... *E05B 17/106* (2013.01); *E05B 1/0007* (2013.01)

(58) Field of Classification Search
CPC ..... E05B 17/06; E05B 1/0007; F21K 9/64; F21V 9/30; F21V 33/0016; F21W 2121/004; F21W 2131/107; A47B 2095/028
See application file for complete search history.

(56) References Cited

U.S. PATENT DOCUMENTS 2,566,490 A * 9/1951 Heinz ..... E05B 17/106 250/465.1
2,699,809 A 1/1955 Nebe
2,753,911 A * 7/1956 Haslett ..... E05B 1/0061 150/155
4,914,554 A * 4/1990 Sowers ..... E05B 17/106 250/466.1
5,008,551 A 4/1991 Randolph
D322,550 S 12/1991 Evans
5,701,635 A * 12/1997 Hawkes ..... E05B 1/0061 16/421
6,132,057 A 10/2000 Williams
6,461,012 B1 10/2002 Shuman
6,729,740 B1 5/2004 Gazard
7,185,929 B2 3/2007 Moyo
7,357,524 B2 * 4/2008 Booty, Jr. ..... E05B 17/106 362/100
7,878,672 B2 2/2011 Yang
2004/0085755 A1 5/2004 Dupont
2006/0209550 A1 * 9/2006 Fabiao ..... E05B 17/10 362/501
2009/0180277 A1 7/2009 Falce
2010/0020530 A1 * 1/2010 Kay ..... E05B 17/106 362/84

* cited by examiner

*Primary Examiner* — Peggy A Neils

(57) ABSTRACT

A fluorescent doorknob assembly for illuminating a doorknob in a darkened environment includes a doorknob that is rotatably mounted on a door for opening the door. A light emitter is coupled to the doorknob. The light emitter is comprised of a fluorescent material thereby facilitating the light emitter to emit light in a darkened environment. In this way the light emitter illuminates the doorknob thereby making the doorknob visible to a user a night.

2 Claims, 4 Drawing Sheets

FLUORESCENT DOORKNOB ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to doorknob devices and more particularly pertains to a new doorknob device for illuminating a doorknob in a darkened environment.

BRIEF SUMMARY OF THE INVENTION

An embodiment of the disclosure meets the needs presented above by generally comprising a doorknob that is rotatably mounted on a door for opening the door. A light emitter is coupled to the doorknob. The light emitter is comprised of a fluorescent material thereby facilitating the light emitter to emit light in a darkened environment. In this way the light emitter illuminates the doorknob thereby making the doorknob visible to a user a night.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
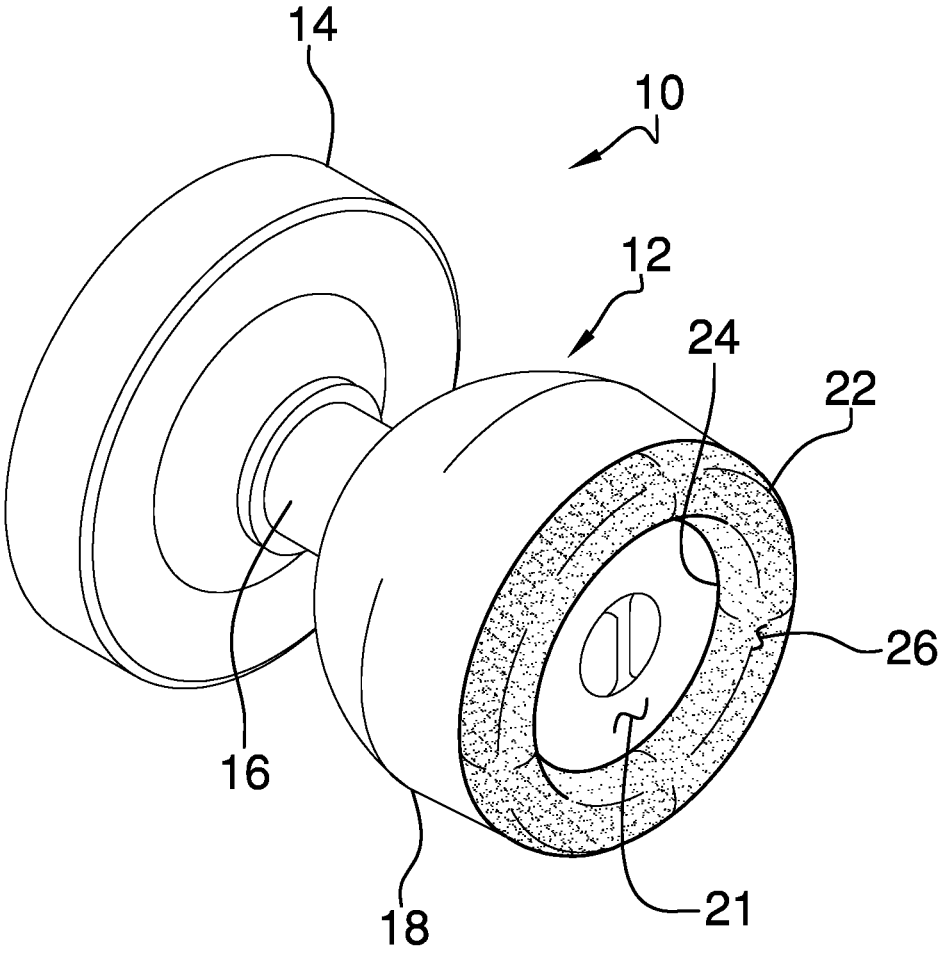
FIG. 1 is a front perspective view of a fluorescent doorknob assembly according to an embodiment of the disclosure.
Figure 2:
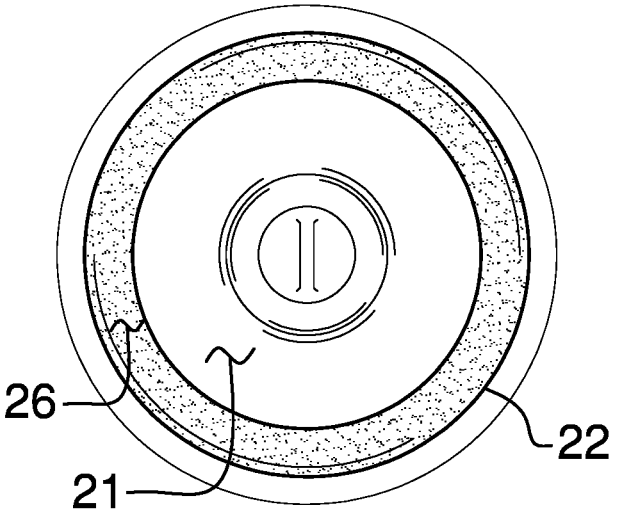
FIG. 2 is a front view of an embodiment of the disclosure.
Figure 3:
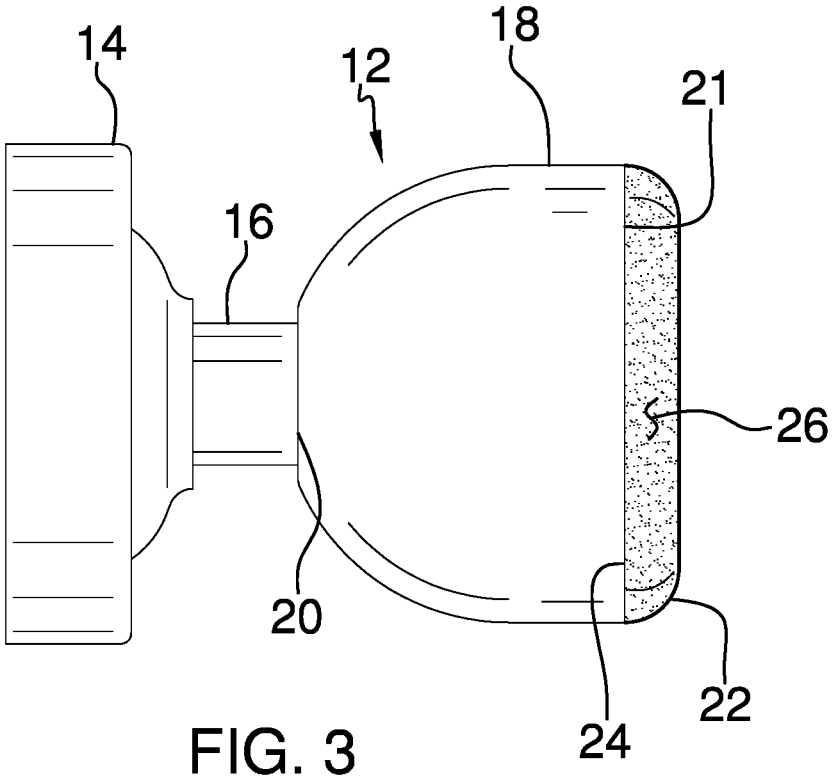
FIG. 3 is a right side view of an embodiment of the disclosure.

With reference now to the drawings, and in particular to FIGS. 1 through 6 thereof, a new doorknob device embodying the principles and concepts of an embodiment of the disclosure and generally designated by the reference numeral 10 will be described.

As best illustrated in FIGS. 1 through 6, the fluorescent doorknob assembly 10 generally comprises a doorknob 12 that is rotatably mounted on a door for opening the door. The door may be a hinged door in an entry into a room in a building or the like. The doorknob 12 has mounting plate 14, a shaft 16 extending outwardly from the mounting plate 14 and a knob 18 that is coupled to a distal end 20 of the shaft 16. Additionally, the knob 18 has a distal surface 21 with respect to the shaft 16. The doorknob 12 may be a doorknob 12 of any conventional design, including but not being limited to, passage doorknobs, privacy doorknobs and any other type of mechanized doorknob.

A light emitter 22 is provided and the light emitter 22 is coupled to the doorknob 12. The light emitter 22 is comprised of a fluorescent material thereby facilitating the light emitter 22 to emit light in a darkened environment. In this way the light emitter 22 makes the doorknob 12 visible to a user a night. The light emitter 22 has a contact surface 24 and an emitting surface 26, and the contact surface 24 is continuous such that the light emitter 22 forms a closed ring. The contact surface 24 is bonded to the distal surface 21 of the knob 18 having the light emitter 22 surrounding a center of the knob 18 and has the emitting surface 26 being exposed. Moreover, the emitting surface 26 is concavely arcuate with respect to the contact surface 24 such that the emitting surface 26 presents a rounded profile. The light emitter 22 may be in integrated component of the doorknob 12 during manufacturing, or the light emitter 22 may be a retrofitted component to existing doorknobs.

Figure 4:
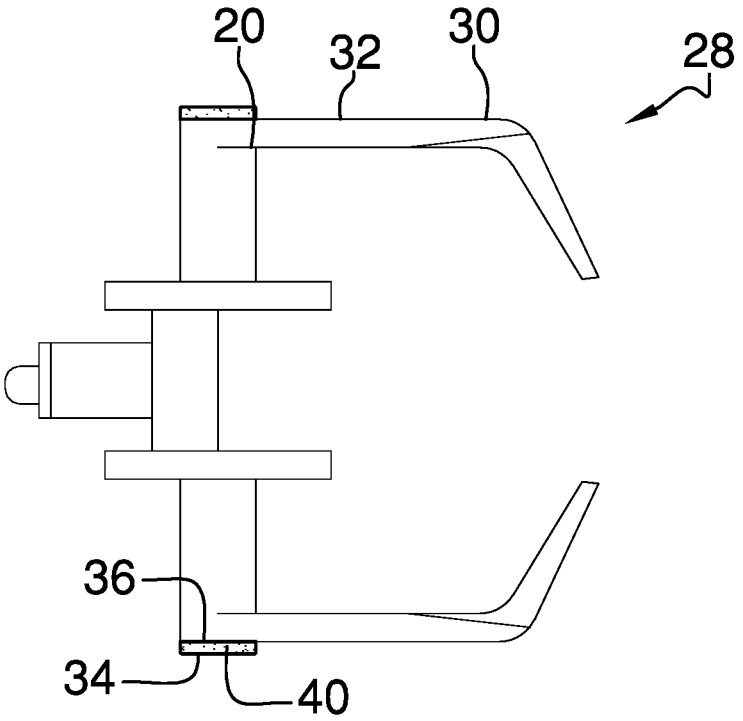
FIG. 4 is a top view of an alternative embodiment of the disclosure.
Figure 5:
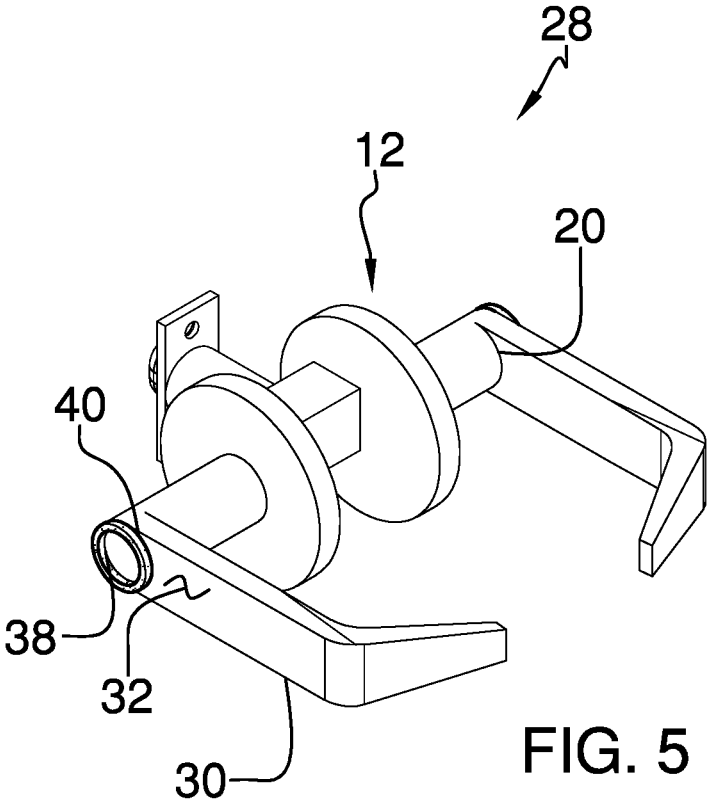
FIG. 5 is a perspective view of an alternative embodiment of the disclosure.
Figure 6:
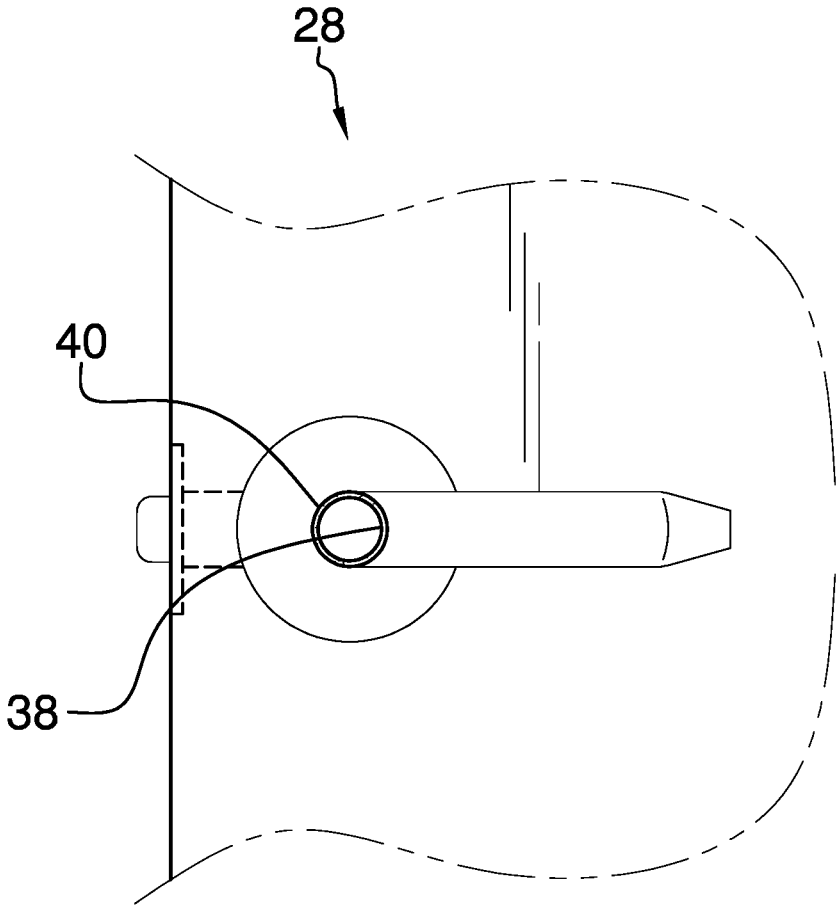
FIG. 6 is a perspective in-use view of an alternative embodiment of the disclosure.

In an alternative embodiment 28 as shown in FIGS. 4, 5 and 6, the doorknob 12 comprises a handle 30 that is coupled to and extends laterally away from the distal end 20 of the shaft 16. The handle 30 has an exposed surface 32 with respect to the distal end 20 of the shaft 16. Continuing in the alternative embodiment 28, the light emitter 22 has a front surface 34, a back surface 36, an inwardly facing surface 38 extending between each of the front 34 and back 36 surfaces and an outwardly facing surface 40 extending between each of the front 34 and back 36 surfaces. Each of the inwardly 38 and outwardly 40 facing surfaces is continuously arcuate such that the light emitter 22 forms a closed ring and the back surface 36 is bonded to the exposed surface 32 of the handle 30.

In use, the light emitter 22 absorbs electromagnetic radiation in the spectrum of visible light during daytime hours, thereby "charging" the light emitter 22. Thus, the light emitter 22 emits the electromagnet radiation in the spectrum of visible light during nighttime hours, or other phenomenon the places the doorknob 12 in a darkened environment. In this way the doorknob 12 is visible to a user in a darkened environment, such as an individual waking at night to go to a bathroom, thereby facilitating the user to manipulate the doorknob 12. Moreover, the fluorescent nature of the light emitter 22 facilitates nighttime illumination of the doorknob 12 without the need for electronic circuitry or an electronic power source.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluorescent doorknob assembly being configured to make a doorknob visible in a darkened environment, said assembly comprising:

a doorknob being rotatably mounted on a door for opening the door, said doorknob having mounting plate, a shaft extending outwardly from said mounting plate and a handle being coupled to and extending laterally away from said distal end of said shaft, said handle having an exposed surface with respect to said distal end of said shaft; and a light emitter being coupled to said doorknob, said light emitter being comprised of a fluorescent material thereby facilitating said light emitter to emit light in a darkened environment wherein said light emitter is configured to make said doorknob visible to a user at night, said light emitter having a contact surface and an emitting surface, said contact surface being continuous such that said light emitter forms a closed ring concentric with said shaft of said doorknob, said contact surface being bonded to said exposed surface of said handle having said light emitter surrounding a center of said exposed surface and having said emitting surface being exposed, said emitting surface being concavely arcuate with respect to said contact surface such that said emitting surface presents a rounded profile with an inwardly facing surface concentric with said shaft whereby said light emitter emits light directly towards a central axis of said light emitter to illuminate an area of said handle surrounded by said light emitter.

2. The assembly according to claim 1, wherein said light emitter has a front surface and a back surface, said inwardly facing surface extending between each of said front and back surfaces, said light emitter having an outwardly facing surface extending between each of said front and back surfaces, each of said inwardly and outwardly facing surfaces being continuously arcuate such that said light emitter forms a closed ring, said back surface being bonded to said exposed surface of said handle.

* * * * *